US005514202A

United States Patent [19]

Lin et al.

[11] Patent Number: 5,514,202

[45] Date of Patent: May 7, 1996

[54] METHOD FOR PRODUCING FINE SILVER-PALLADIUM ALLOY POWDER

[75] Inventors: Jing-Chie Lin; Yung-Bao Deng; Sheng-Long Lee, all of Chung-li, Taiwan

[73] Assignee: National Science Council of R.O.C., Taipei, Taiwan

[21] Appl. No.: 360,214

[22] Filed: Dec. 20, 1994

[51] Int. Cl.[6] ..... B22F 1/00

[52] U.S. Cl. ..... 75/351; 75/371

[58] Field of Search ..... 75/351, 370, 371, 75/721, 741; 420/505

[56] References Cited

U.S. PATENT DOCUMENTS 3,390,981 7/1968 Hoffman ..... 75/351
4,776,883 10/1988 Hayashi et al. ..... 75/365
5,292,359 3/1994 Jeng-Shyong et al. ..... 75/351
5,413,617 5/1995 Lin et al. ..... 75/371

*Primary Examiner*—John Sheehan
*Attorney, Agent, or Firm*—Morgan & Finnegan

[57] ABSTRACT

A method for producing fine silver-palladium alloy powder includes the steps of: (A) preparing separately a silver nitrate solution and a palladium nitrate solution and mixing the solutions, and then adding a neutralizing and complexing agent to the mixed solutions to adjust the pH thereof to about 2.5–3.5, whereby a first mixture containing silver and palladium ions is obtained; (B) preparing a second mixture containing a reductant and a surfactant; (C) bringing the first mixture into contact with the second mixture at a reaction temperature of 15°–50° C. under stirring in order to permit the silver and palladium ions to be reduced and to coprecipitate so as to form silver-palladium alloy particles; and (D) recovering the coprecipitated silver-palladium alloy particles, thereby obtaining the fine silver-palladium alloy powder.

13 Claims, 5 Drawing Sheets

METHOD FOR PRODUCING FINE SILVER-PALLADIUM ALLOY POWDER

BACKGROUND OF THE INVENTION

1. Field of the Invention

This invention relates to a method for producing fine silver-palladium powder by chemical reduction, and more particularly to a method for producing fine silver-palladium alloy powder which can be carried out in a continuous mode and in which the specific surface area of the silver-palladium alloy powder can be controlled.

2. Description of the Related Art

Silver-palladium powder is formulated with glass powders and resins to form pastes that are used in thick film conductive circuits. The surface characteristics of silver-palladium powders vary depending upon their specific surface areas, the particle sizes, the particle size distributions and the tap densities. Some well known methods of producing silver-palladium powder include (1) blending silver and palladium powders under mechanical stirring, (2) an electrochemical reduction method, (3) a spray-pyrolysis method and (4) a chemical coprecipitation method. There are some problems encountered in the blending method. For example, it takes a very long time to obtain a powder blend, and a homogeneously blended powder is hardly achieved. Furthermore, the blended powder undergoes abnormal expansion and shrinkage during heat treatment (200°–500° C.). This tendency becomes more severe as the thickness of the conductive film becomes thinner. When the electrochemical reduction method is used, the resulting silver-palldium powder is generally nonhomogeneous. In addition, a lot of time and energy is consumed, thereby increasing the production cost. Thus, the electrochemical reduction method is not suitable for commercial use.

In J. Mater Sci. 26 (1991) 2477–2482, Nagashima et al. suggested that silver-palladium alloy powder can be produced by spray-pyrolysis. Although the silver-palladium alloy powder so produced has a sintering characteristic better than that of the mechanically mixed silver-palladium powder, it has a relatively large particle diameter (0.1–10 μm), thereby limiting its application.

Accordingly, presently available commercial silver-palladium powders are generally produced by chemical coprecipitation. Conventional coprecipitation processes for the production of silver-palladium powders include the steps of: mixing two solutions prepared by dissolving silver and palladium separately in two nitric acid solutions; and adding a reducing agent, such as hydrazine, formaldehyde or hypophosphorous acid, into the mixed solution to reduce and coprecipitate silver and palladium ions as silver-palladium alloy particles. Filtering, washing and drying follow after coprecipitation so as to obtain the silver-palladium alloy powder. Such a process has been disclosed in U.S. Pat. Nos. 3,390,981 and 4,776,883.

U.S. Pat. No. 4,776,883 to Hayashi et al. further suggests a subsequent heat-treatment step after coprecipitation to obtain fine silver-palladium powder having characteristics satisfying the requirements of ceramic capacitors. In particular, the obtained powder is subjected to a subsequent heat treatment at a temperature of 100°–500° C. under an inert atmosphere or vacuum. The additional heat treatment step complicates the process and increases the production cost.

U.S. Pat. No. 5,292,359 teaches a process in which water is added as a diluent to the mixture of silver and palladium nitrate solutions in order to adjust the concentration and the pH of the solutions and in which the resulting solutions are mixed with a mixture containing a reducing agent and a surfactant for reduction and coprecipitation. This reduction and coprecipitation process is a batch-type process. Since reduction and surface treatment take place at the same time in the process, the production procedure is simplified and is suitable for mass production. In addition, the resulting powder is fine and suitable for forming electronic conductive films. Nevertheless, the process involves the risks that a mixed type silver and palladium powder is produced rather than an alloy type silver-palladium alloy powder and that the product quality is unstable and varies from batch to batch. Accordingly, the process cannot provide a high quality product with a predetermined specific surface area and particle size.

Until now, batch type processes have been suggested for the production of silver-palladium alloy powders and such processes are generally difficult for the production of powders having controlled or predetermined surface characteristics such as specific surface area, particle size distribution, and tap density. As per the requirements of the thick film electronic industries, silver-palladium powders should be an alloy and the surface characteristics of the alloy powders should be matchable with glass powders and resins to ensure the formation of high quality conductive thick films. Further developments in this aspect are thus desirable.

SUMMARY OF THE INVENTION

Accordingly, an objective of this invention is to provide an improved method which can ensure the formation of an alloy type silver-palladium powder by adjusting the pH value of reactants.

Another objective of the invention is to provide a method which can be carried out in a continuous process by monitoring the potential of the reaction mixture, and by which the specific surface area of the silver-palladium alloy powder can be controlled through adjustment of the reaction temperature of the process.

According to the present invention, a method for producing fine silver-palladium alloy powder comprises the steps of: (A) preparing separately a silver nitrate solution and a palladium nitrate solution and mixing the solutions, and then adding a neutralizing and complexing agent to the mixed solutions to adjust the pH thereof to about 2.5–3.5, whereby a first mixture containing silver and palladium ions is obtained; (B) preparing a second mixture containing a reductant and a surfactant; (C) bringing the first mixture into contact with the second mixture at a reaction temperature of 15°–50° C. under stirring in order to permit the silver and palladium ions to be reduced and to coprecipitate so as to form silver-palladium alloy particles; and (D) recovering the coprecipitated silver-palladium alloy particles, thereby obtaining the fine silver-palladium alloy powder.

In the present invention, the neutralizing and complexing agent may be an aqueous ammonia solution. The reductant may be hydrazine. The surfactant may be a mixture of triethanolamine and caprylic acid or a glycerin.

In one aspect of the present invention, the mixture of two nitrate solutions is adjusted to a pH of 2.5–3.5 via control of the amount of the neutralizing and complexing agent, and the reaction temperature is maintained at a determined constant temperature in the range of 15°–50° C. in order to obtain a silver-palladium alloy powder having a desired specific surface area, a fine particle size and a uniform size distribution.

In another aspect of the present invention, the method can be carried out in a continuous process by monitoring the potential of the reaction mixture during the reduction reaction. The reactants may be pumped respectively and simultaneously at the same rate into a constant-temperature reactor. The reduction reaction is considered to be complete when the potential of the reaction mixture becomes constant. The recovering step can proceed at this stage.

BRIEF DESCRIPTION OF THE DRAWINGS

Other features and advantages of the present invention will become apparent in the following detailed description of the preferred embodiments, with reference to the accompanying drawings, in which.

DETAILED DESCRIPTION OF THE PREFERRED EMBODIMENTS

In the present invention, an aqueous ammonia solution is added as a neutralizing and complexing agent to a mixed solution containing silver and palladium ions in order to bring the potentials of silver and palladium ions closer to each other so as to ensure the formation of an alloy type silver-palladium powder. According to the principle of alloy electroplating (Walker, Chem. Ind. 4, (1980), 260), if the difference between the standard electrode potentials ($E_0$) of two metals is within a range of 0.2 V, an alloy powder can be simply obtained by coelectroplating from metal salt solutions. When the potential difference is greater than 0.2 V, an additive should be added in order to bring the potentials of the two metals closer and thereby produce an alloy powder. In Powd. Metall. Met. Ceram. 12 (1973) 443, B. P. Yur'ev and S. P. Shkuyakova, there is suggested a method in which an aqueous ammonia solution is added to a mixture of silver nitrate and palladium nitrate solutions to form an electrolyte solution which produces a dendritic silver-palladium alloy powder. However, the particle size of the powder so obtained is non-uniform.

In contrast to the above-mentioned electroplating process, when an aqueous ammonia solution is utilized as a neutralizing and complexing agent to reduce the potential difference between silver and palladium ions, the coprecipitation process according to the present invention provides a surprising result that a silver-palladium alloy powder can be obtained with fine particle size and uniform particle size distribution. It is known that the reduction potentials of silver and palladium ions are respectively 0.80 V and 0.99 V, and thus, the potential difference thereof substantially reaches the critical value of 0.2 V. When the basic aqueous ammonia solution is added to the mixed solution containing silver and palladium ions, the potential difference between silver and palladium ions is reduced from 0.2 V to 0.15 V, thereby promoting the formation of a fine alloy powder during the reduction reaction.

Figure 1:
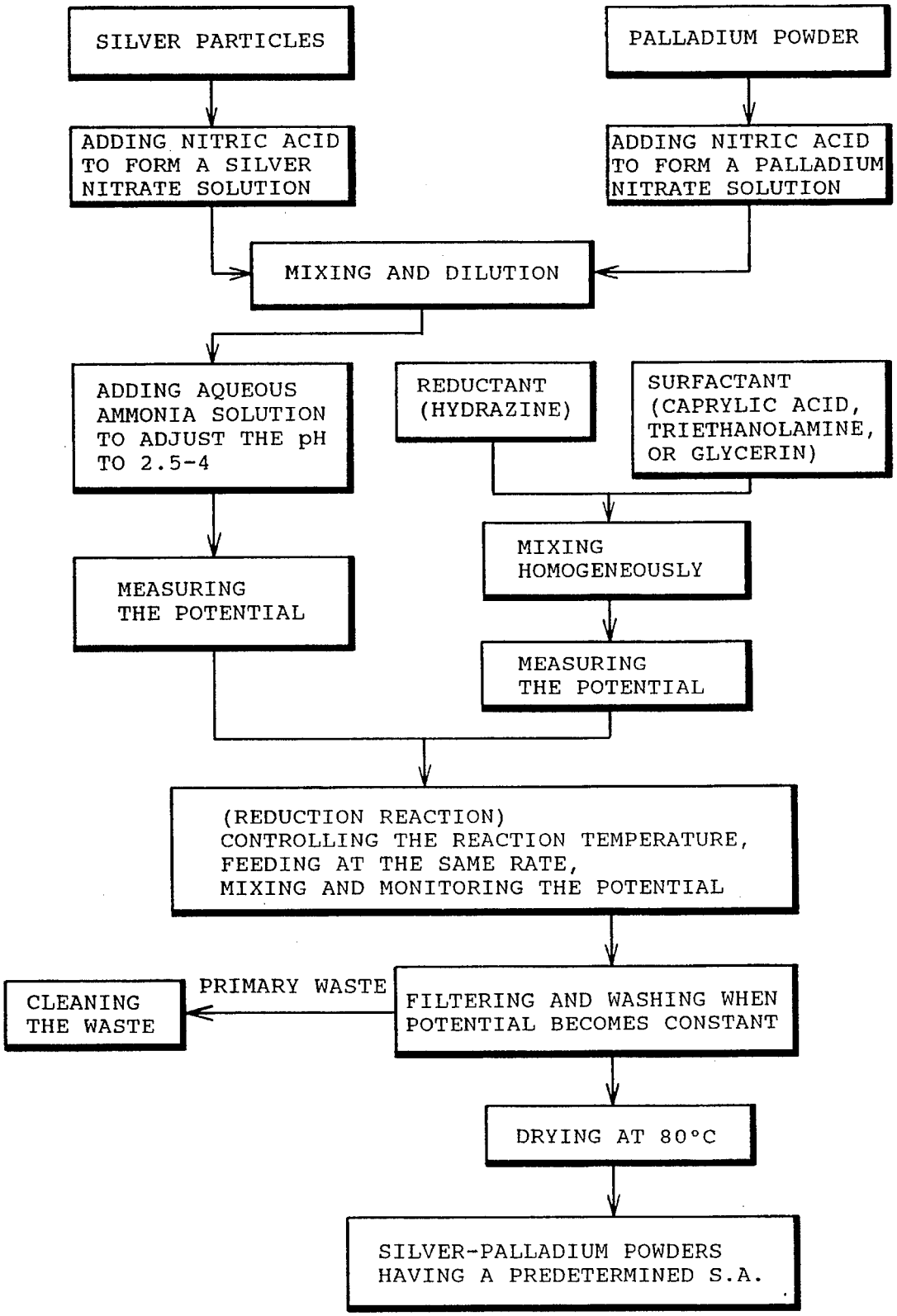
FIG. 1 is a flow diagram illustrating the process of this invention for producing fine silver-palladium alloy powder.

Referring to FIG. 1, an embodiment of the method of the present invention includes the steps of: (a) dissolving separately silver particles and palladium powder in nitric acid solutions under heating, mixing the nitric acid solutions and diluting the resultant mixed nitric acid solution with water; (b) adding an aqueous ammonia solution into the mixed diluted nitric acid solution until a pH value of 2.5–3.5 is reached, whereby a first mixture is obtained; (c) preparing a second mixture containing 3–10% hydrazine as a reductant and 1.5–3% caprylic acid and triethanolamine as a surfactant; (d) keeping the reaction temperature at a predetermined constant temperature (15°–50° C.) and measuring respectively initial potentials of the first and second mixtures, wherein the initial potentials of the first and second mixtures are respectively 350 mV and −840 mV with respect to a saturated calomel electrode (SEC), and then mixing homogeneously the first and second mixtures by bringing the first and second mixtures into contact with each other at the same rate (150–200 ml/min) under stirring (300 rpm) and monitoring simultaneously the potential of the reaction mixture; and (f) filtering the reaction product after the reaction proceeds about 15–25 minutes and the potential thereof reaches a stable value of about −600 mV.

By the use of the aqueous ammonia solution, the pH value of the mixed diluted nitric acid solution is raised and complex ions of $[Ag(NH_3)_2]^+$ and $[Pd(NH_3)_4]^{2+}$ are formed. The potential difference between silver and palladium ions is lowered substantially from 0.2 V to 0.15 V. This facilitates the formation of silver-palladium powder of completely alloy type. The reaction is kept at a constant temperature and the potential variation during the reduction of silver and palladium ions is monitored continuously. The reduction reaction is considered to cease when the potential ceases to vary. Filtration, washing and drying processes are performed subsequently. In the present invention, the first and second mixtures can be fed respectively and simultaneously into a constant temperature reactor at the same rate, and the reaction finishes when the potential in the reactor becomes constant. In this way, fine silver-palladium alloy powder having a uniform particle size can be formed. At a higher reaction temperature, the so-called "embryos" of the alloy powder grow quickly to stable nuclei having a radius over the critical radius. The amount of stable nuclei formed is large so that the resulting particles are fine and so that the resulting specific surface area is high. At a lower reaction temperature, stable nuclei are hardly formed. Therefore, the amount of the stable nuclei formed is less and the resultant particles are large, thereby decreasing the specific surface area.

Figure 2:
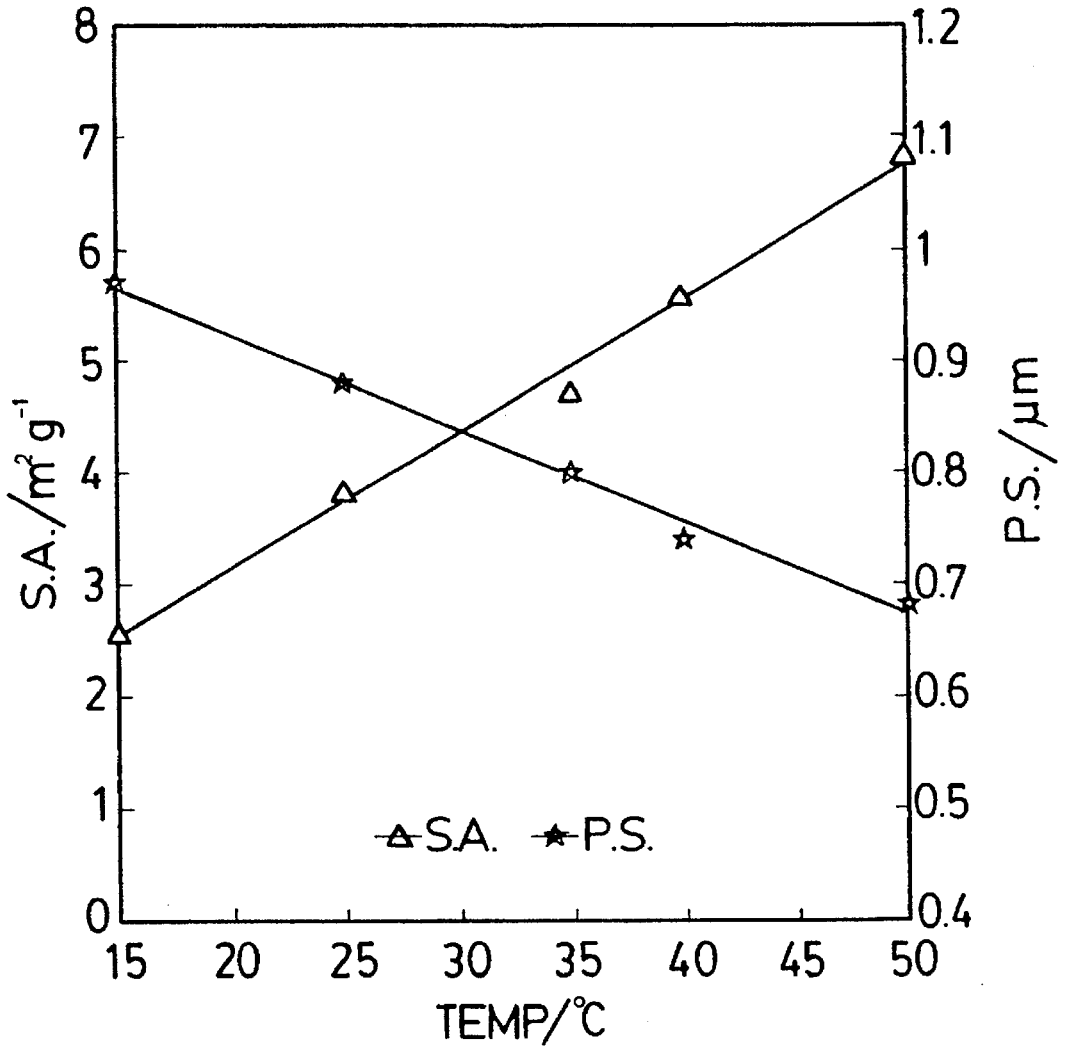
FIG. 2 is a plot illustrating the relationships among the reaction temperatures and the specific surface areas and the particle sizes of the fine silver-palladium alloy powder.
Figure 3:
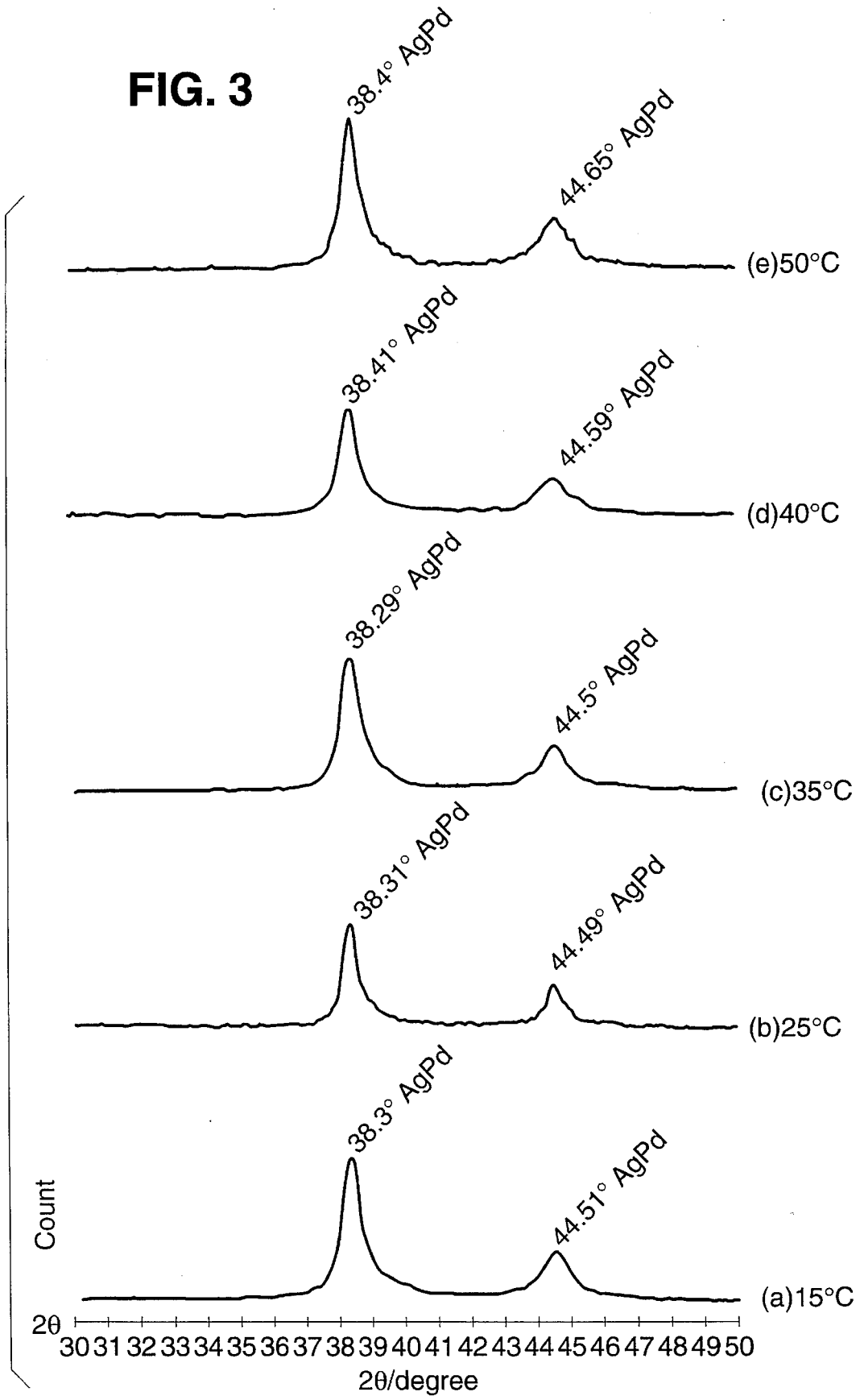
FIG. 3 shows X-ray diffraction graphs of the fine silver-palladium alloy powder obtained by performing the present invention at different temperatures.
Figure 4A:
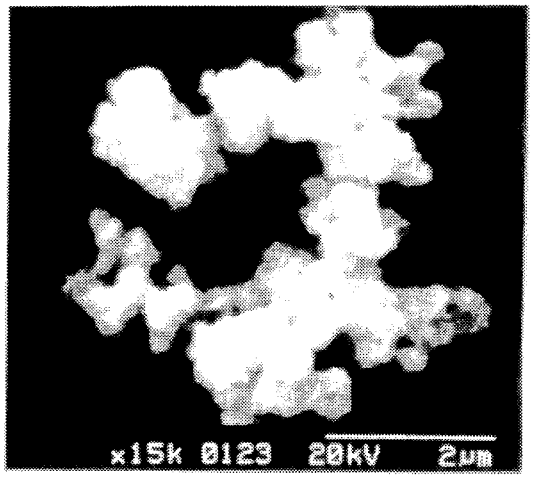
FIGS. 4*a* to 4*e* are magnified photographs of the fine silver-palladium alloy powder taken by SEM.
Figure 4B:
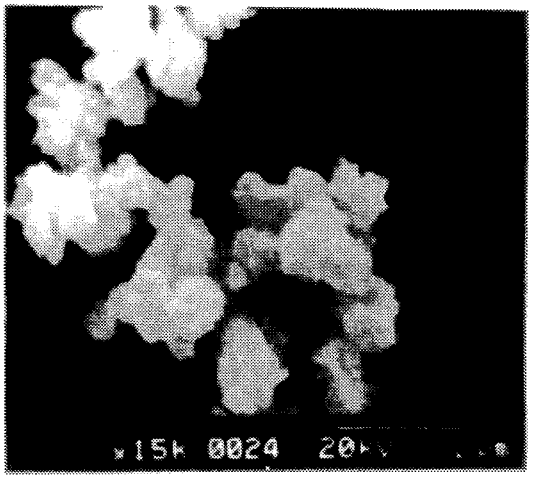
Figure 4C:
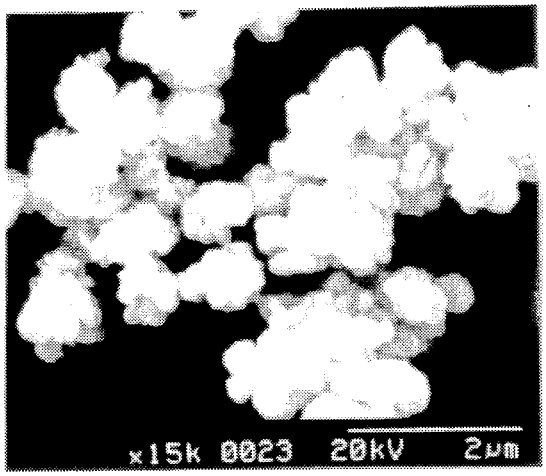
Figure 4D:
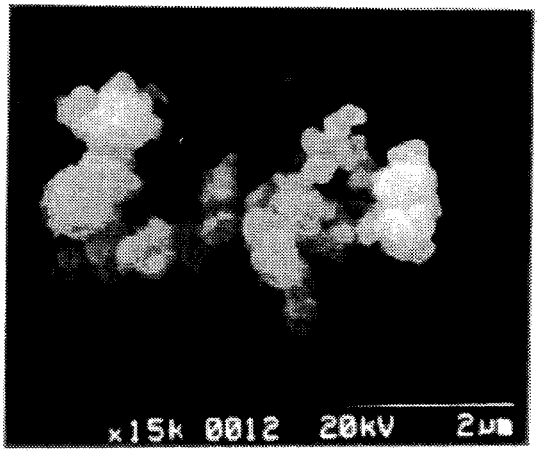
Figure 4E:
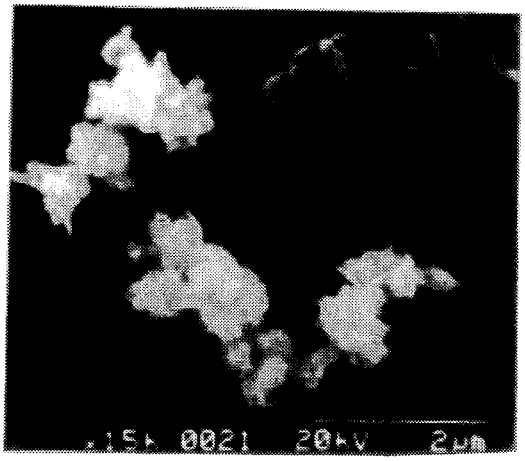
Figure 5:
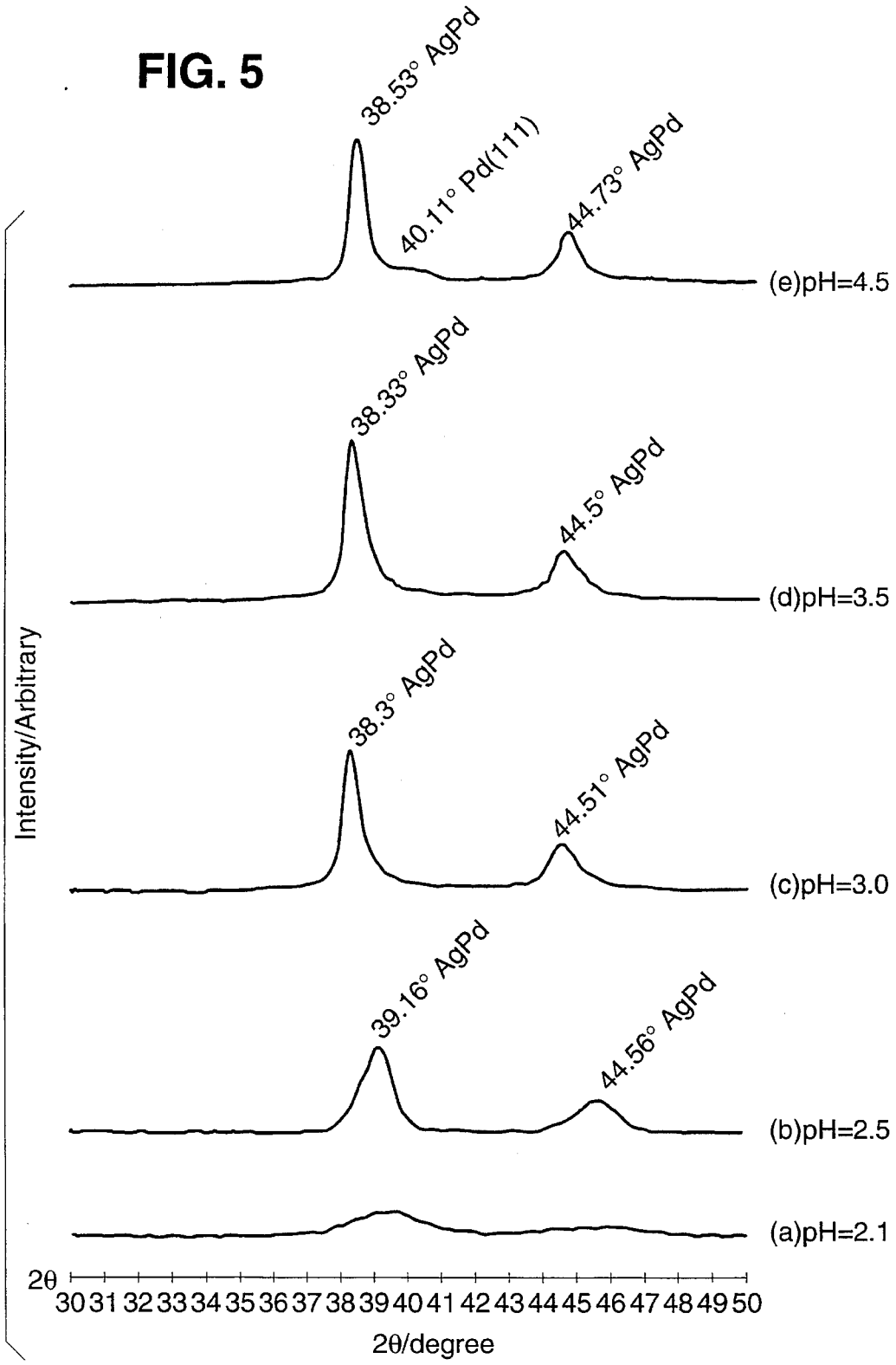
FIG. 5 shows X-ray diffraction graphs of the fine silver-palladium alloy powder obtained at different pH values.

FIG. 2 illustrates the relationships among the reaction temperatures, the specific surface areas and the particle sizes of the silver-palladium alloy powder. It was noted that the specific surface area increases and the particle size decreases as the reaction temperature increases. Linear relationships were found between the specific surface area and the reaction temperature and between the particle size and the reaction temperature. With such linear relationships, the desired particular specific surface area and particle size can be obtained easily by controlling the temperature of reduction reaction. Controlling the reaction temperature to obtain a desired surface area is easier and simpler to conduct than the prior art, which controls the concentration of the reactants and which utilizes mechanical-grinding for size reduction. Furthermore, a more accurate control can be achieved in the present invention.

In order to obtain a desired specific surface area and/or a desired particle size, the required reaction temperature can be determined with reference to the predetermined plots of temperature vs. specific surface area and/or particle size.

The present invention will be further illustrated by the following examples.

EXAMPLE 1

In accordance with the steps disclosed in FIG. 1, 68 g of 99.99% silver particles are dissolved in 70 ml of 68–71% nitric acid solution. 130 ml of pure water is added thereinto under heating and stirring until a 120 ml homogeneous solution is achieved. 12 g of 99.9% palladium powder is dissolved in 600 ml of 68–71% nitric acid solution under heating and stirring until a 400 ml homogeneous solution is achieved. The resulting solutions are mixed and then diluted with water until the total volume thereof is 4000 ml. The diluted solution has a pH value of 0.1 and a silver concentration of 17 g/l and a palladium concentration of 3 g/l After adding 30 ml of a 28% aqueous ammonia solution into 400 ml of the above diluted solution, the pH thereof becomes 3.5 and the potential thereof is 350 mV with respect to the calomel reference electrode. A first mixture is thereby obtained. 20 ml hydrazine, 6 ml triethanolamine and 6 ml caprylic acid are mixed and diluted with water until a volume of 400 ml is reached. The resulting solution will be referred to hereinafter as a second mixture. Each of the first and second mixtures is contained in a flask and is kept at a temperature of 50° C.

The two mixtures are then fed respectively and simultaneously by a quantitative pump at the same rate of 150 ml/min into a reactor where they are stirred at 300 rpm. After 20 minutes, the potential of the reaction mixture decreases from an initial value of −200 mV to a final stable value of −500 mV. At this time, the reduction reaction finishes. The coprecipitated silver-palladium alloy particles are then recovered by filtration, washing and drying, thereby forming silver-palladium alloy powder. The powder characteristics of the silver-palladium alloy powder are shown in Table 1, wherein the specific surface area is 6.81 $m^2/g$.

EXAMPLE 2

The experiment conducted in this example is substantially similar to that of Example 1 except that the reaction temperature is kept at 40° C. The results of this example are shown in Table 1, wherein the specific surface area is 5.58 $m^2/g$.

EXAMPLE 3

The experiment conducted in this example is substantially similar to that of Example 1 except that the reaction temperature is kept at 35° C. The results of this example are shown in Table 1, wherein the specific surface area is 4.72 $m^2/g$.

EXAMPLE 4

The experiment conducted in this example is substantially similar to that of Example 1 except that the reaction temperature is kept at 25° C. The results of this example are shown in Table 1, wherein the specific surface area is 3.82 $m^2/g$.

EXAMPLE 5

The experiment conducted in this example is substantially similar to that of Example 1 except that the reaction temperature is kept at 15° C. The results of this example are shown in Table 1, wherein the specific surface area is 2.56 $m^2/g$.

TABLE 1

| Examples | H wt % | T wt % | C wt % | pH | reaction temperature | T.D. $g/cm^3$ | S.A. $m^2/g$ | P.S. (μm) | powder type | recovery (%) |
|---|---|---|---|---|---|---|---|---|---|---|
| 1 | 5 | 1.5 | 1.5 | 3.5 | 50 | 0.66 | 6.81 | 0.68 | alloy | 99.9 |
| 2 | 5 | 1.5 | 1.5 | 3.5 | 40 | 0.86 | 5.58 | 0.74 | alloy | 99.5 |
| 3 | 5 | 1.5 | 1.5 | 3.5 | 35 | 0.92 | 4.72 | 0.80 | alloy | 99.2 |
| 4 | 5 | 1.5 | 1.5 | 3.5 | 25 | 1.01 | 3.82 | 0.88 | alloy | 99.0 |
| 5 | 5 | 1.5 | 1.5 | 3.5 | 15 | 1.08 | 2.56 | 0.97 | alloy | 98.8 |

feeding rate: 150 ml/min
stirring rate: 300 RPM
H: hydrazine
T: triethanolanine
C: caprylic acid The silver-palladium powders of Examples 1 to 5 are analyzed by an induced coupling plasma mass spectrometer and contain 84.9% silver and 15.1% palladium.

In Table 1, T.D. (Tap Density) is determined by ASTM B572 (Standard Test Method for Tap Density of Powders of Refractory Metals and Compounds by Tap-Pak Volumeter). S.A. (Specific Surface Area) is determined by Micromeritics nitrogen-adsorption specific surface area measuring meter. P.S. (Particle distribution) is determined by Micromeritics Particle Distribution Analyzer.

While the present invention has been described in connection with what is considered the most practical and preferred embodiment, it is understood that this invention is not limited to the disclosed embodiment but is intended to cover various arrangements included within the spirit and scope of the broadest interpretations and equivalent arrangements.

I claim:

1. A method for producing fine silver-palladium alloy powder, comprising the steps of:

(A) preparing separately a silver nitrate solution and a palladium nitrate solution and mixing said solutions, and then adding a neutralizing and complexing agent to the mixed solutions to adjust the pH thereof to about 2.5–3.5, whereby a first mixture containing silver and palladium ions is obtained;

(B) preparing a second mixture containing a reductant and a surfactant;

(C) bringing said first mixture into contact with said second mixture at a reaction temperature of 15°–50° C. under stirring in order to permit said silver and palladium ions to be reduced and to coprecipitate so as to form silver-palladium alloy particles; and (D) recovering the coprecipitated silver-palladium alloy particles, thereby obtaining the fine silver-palladium alloy powder.

2. A method as claimed in claim 1, wherein said silver nitrate solution has a silver concentration of 17 g/l, and said palladium nitrate solution has a palladium concentration of 3 g/l.

3. A method as claimed in claim 1, wherein said reductant is hydrazine.

4. A method as claimed in claim 1, wherein said neutralizing and complexing agent is an aqueous ammonia solution.

5. A method as claimed in claim 1, wherein said surfactant is a mixture of triethanolamine and caprylic acid.

6. A method as claimed in claim 1, wherein said silver-palladium alloy powder has a specific surface area of 2–7 $m^2/g$.

7. A method as claimed in claim 1, wherein said method further comprises (B1) measuring respectively initial reduction potentials of said first and second mixtures before said step (C), and (C1) monitoring continuously the reduction potential of the reaction mixture containing said first and second mixtures before said step (D).

8. A method as claimed in claim 7, wherein said initial reduction potentials of said first and second mixtures are respectively about 350 mV and −840 mV with respect to a calomel reference electrode.

9. A method as claimed in claim 8, wherein the step (C) comprises feeding said first and second mixtures into a constant-temperature reactor substantially at the same rate, and wherein the step (D) comprises (D1) filtering said silver-palladium alloy particles when the reduction potential of the reaction mixture becomes constant.

10. A method as claimed in claim 1, wherein said first and second mixtures are mixed at a stirring speed of 250–350 rpm in the step (C).

11. A method as claimed in claim 7, wherein the step (c) further comprises controlling said reaction temperature; said temperature to be determined from a plot of reaction temperatures vs specific surface areas, said plot having been generated from prior observations of reaction temperatures and specific surface areas.

12. A method as claimed in claim 11, wherein said plot exhibits a linear relationship between the reaction temperature and the specific surface area of the silver-palladium alloy powder.

13. A method as claimed in claim 1, wherein said surfactant is glycerin.

* * * * *